US007289080B1

(12) United States Patent
Bohlman

(10) Patent No.: US 7,289,080 B1
(45) Date of Patent: Oct. 30, 2007

(54) ULTRA BROADBAND LINEAR ANTENNA

(75) Inventor: Walter A Bohlman, Quakertown, PA (US)

(73) Assignee: Bae Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 11/427,002

(22) Filed: Jun. 28, 2006

(51) Int. Cl.
*H01Q 9/16* (2006.01)
*H01Q 9/04* (2006.01)

(52) U.S. Cl. ..... 343/793; 343/791

(58) Field of Classification Search ..... 343/791, 343/792.5, 793
See application file for complete search history.

(56) References Cited

U.S. PATENT DOCUMENTS 2,229,865 A 1/1941 Morgan
3,277,487 A 10/1966 Berry et al.
4,087,823 A 5/1978 Faigen et al.
5,604,507 A 2/1997 Openlander
5,644,321 A 7/1997 Benham
6,483,471 B1 * 11/2002 Petros ..... 343/725
7,053,851 B1 * 5/2006 Bogdans et al. ..... 343/792

FOREIGN PATENT DOCUMENTS

GB 2397696 A 7/2004
WO 2004/010527 A3 1/2004

* cited by examiner

*Primary Examiner*—Shih-Chao Chen
(74) *Attorney, Agent, or Firm*—Vern Maine & Associates

(57) ABSTRACT

An antenna of dipole and monopole antenna elements with filtering to achieve a greater bandwidth. The multiple antenna elements are isolated or combined in order to provide a self adjusting electrical length by using multi-terminal filtering.

20 Claims, 5 Drawing Sheets two terminal filter two terminal trap filter

ULTRA BROADBAND LINEAR ANTENNA

FIELD OF THE INVENTION

The invention relates to communications, and more particularly, to broadband linear antennas.

BACKGROUND OF THE INVENTION

The reception and transmission of electronic signals is generally accomplished using some type of antenna structure. Ideally, a single compact antenna would be able to adequately handle a wide bandwidth. However, there are significant limitations to such an ideal antenna. With respect to monopole and dipole antennas, there have been various efforts to extend the bandwidth and varied designs to improve performance over a certain bandwidth. However, these antennas have a limited operational bandwidth, as the bandwidth is related to the physical dimensions of the length of the antenna as well as other factors such as the frequency of interest, the variation of impedance, and the radiation pattern.

Linear antennas such as dipoles and monopoles have a well-known bandwidth limitation in the order of 3:1. Various schemes have been used to extend the bandwidth consisting of a series of tuned traps and resistors. However, the traps give multi frequency response to linear antennas, but relative constant characteristics have been difficult to obtain. The resistors make the antennas a traveling wave structure, but pattern performance is still limited to about 3:1.

There are several techniques to obtain broadband antenna operation. One scheme uses low loss resonant circuits inserted into the linear antenna at strategic points. For discussion purposes it will be assumed that the monopole extends over an infinite ground plane. A $\lambda/4$ wavelength long antenna has a radiation pattern that has a null on the axis of the monopole and peak energy on the ground plane. Extending the length or raising the frequency to an equivalent length of $5/8\lambda$ increases the gain on the horizon (ground plane) and starts to form a secondary lobe.

When the antenna reaches one wavelength, the beam peak has lifted off of the horizon to about 45 degrees. Now if a parallel resonant circuit is placed along the wire at the $\lambda/4$ length, ideally this will maintain the $4\times f1$ currents at a length less than $\lambda/4$. This occurs because the parallel resonant circuit presents high impedance to the current at $4\times f1$, and disconnects the remaining length of the antenna for the resonant frequency of the parallel resonant circuit (trap) but on the high side of resonance the net reactance is low thus reconnecting the extremity of the antenna and preventing operation above $4\times f1$. Current schemes have attempted to place a large number of traps in a log periodic fashion along the length of the antenna with somewhat limited success.

FIG. 3*a* and FIG. 3*b* illustrate two terminal filters used in state of the art designs. These present type of filter designs have several short comings as described herein. A capacitor and an inductor can be coupled in series, such as shown in FIG. 3*a*, or coupled in parallel as shown in FIG. 3*b* to achieve certain filtering characteristics or design criteria. One such short coming of two terminal filters is that there are only two terminals provided for any filtering action.

There have been other attempts to achieve broadband operation by placing a resistive element about $\lambda/4$ from the far end of an antenna. This technique tends to improve the VSWR and operate over a substantially wider portion of the frequency range than did multiple traps. The beam lifts off of the ground plane above the frequency associated with a monopole length of about $0.8\lambda$.

Another concept inserts resistors at even increments along the antenna. This concept showed that an antenna could be developed for extremely wide bandwidth by isolating the extremities and allows the use of elements at multiple frequencies. But, this concept has low efficiency because of the liberal use of resistors. Also, the use of resistors would in general limit the use to relatively low power operation.

What is needed, therefore, are techniques for providing broadband coverage without the aforementioned problems. There should be a broadband antenna system that enhances existing designs for manufacturability and ease of implementation, but that expands the bandwidth coverage.

SUMMARY OF THE INVENTION

One embodiment of the invention is a wideband antenna, comprising a central coaxial feed having a first end coupled to a reference plane and a second end coupled to a first diplexing filter. There is a second coaxial section having a first end of the second coaxial section coupled to the first diplexing filter and an opposing end of the second coaxial section coupled to a second diplexer filter, wherein a first end of a third coaxial section is coupled to the second diplexer filter and an opposing end of the third coaxial section is coupled to a transformer, and wherein the transformer is coupled to the reference plane. There is a first dipole antenna coupled to the first diplexing filter, a second dipole antenna coupled to the second diplexing filter, and a monopole antenna coupled to the transformer.

The wideband antenna can have a self adjusting electrical length with the first diplexing filter providing a first frequency path to the first dipole antenna and a second frequency path to the second coaxial section. The second coaxial section couples to the second diplexing filter and the second dipole antenna, and wherein the second filter provides a third frequency path to the third coaxial section which is terminated in the transformer and the monopole antenna.

One aspect includes where the primary filters providing the broadband performance are four terminal diplexing filters.

Another aspect includes wherein one of the pair of monopole elements is coupled on one end to the reference plane and to the second pair of dipole elements on another end, and wherein one of the pair of monopole elements is coupled via a resistive element to the first pair of dipole elements.

A further feature includes, wherein the antenna achieves bandwidths of at least about 50:1. The antenna can further comprise at least one additional pair of dipole elements, at least one additional filter, and at least one additional coaxial section. A transformer can also be coupled between the reference plane and the third coaxial section. The antenna elements may have a cross-section shape selected from at least one of the group consisting of: circular, square, polygonic, oval, and triangular.

Another embodiment of the invention is an antenna system for wideband operations having a monopole antenna and at least one self-adjusting dipole antenna, comprising a plurality of tubular sections forming at least one dipole antenna, and the monopole antenna, the dipole antenna having dipole sections linearly disposed between a first monopole element and a second monopole element, wherein the dipole sections and the first and second monopole element are electrically coupled. There is a central coaxial feed linearly disposed proximate the tubular sections and coupled on a first end to an input signal about a reference plane. There is at least one coaxial section linearly disposed proximate the tubular sections and coupling between the reference plane and a second end of the central coaxial feed, and at least one four terminal diplex unit coupled between each dipole antenna. A further variation includes at least one ferrite bead coupled about any coaxial section.

The diplex unit can provide two frequency paths depending upon a frequency of the input signal. The self-adjusting dipole antenna further may comprise at least one additional dipole antenna, at least one additional diplexer, and at least one additional coaxial section respectively coupled therewith.

A further embodiment is a method for providing broadband coverage from a combination of and at least one dipole antenna and a monopole antenna, comprising feeding an input signal to a first dipole antenna from a first coaxial cable via a first diplexer for a first frequency range, automatically switching from the first dipole antenna to a second coaxial cable for a second frequency range, wherein the second frequency range is lower than the first frequency range, feeding a second dipole antenna coupled to the second coaxial cable with the second frequency range, and automatically switching from the second dipole antenna to a third coaxial cable for a third frequency range, wherein the third frequency range is lower than second frequency.

One embodiment of the present invention comprises multiple collocated antennas combined with various filter networks to produce wide bandwidth. One of the embodiments provides a very broadband omni-directional combination of a monopole antenna and a dipole antenna.

A feature of the present invention is that it adds an array of filters to linear antennas in such a manner as to increase the bandwidth. In one embodiment at least two diplexing filters are used.

In another embodiment the present invention uses a filter at each of the various insertion points of the antenna. The simple traps previously used degrade into a low impedance network just above the resonance and thus the extremities of the antenna are still connected. The use of filters taught by the present invention at various places along the antenna permits the high frequency currents to be isolated from the extremities of the antenna and thus provide constant performance over a much greater frequency range.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention relates to an antenna that combines dipole and monopole antenna elements with filtering in order to achieve a greater bandwidth. For example, the present invention teaches a system to achieve bandwidths of 50:1 or greater, for example a range of about 30 MHz to 1500 MHz. The term wideband ultra wideband and similar terms have equivalent meanings ad described herein unless otherwise indicated.

The present filter designs have several short comings as described herein. One such short coming is that only two terminals are typically provided for any filtering action. The present invention provides multiple applications of multi-terminal filters which allow a much more extensive use of filter concepts. In one embodiment, a number of dipole antenna sections surround a central feed coax and have monopole antenna elements at the ends, wherein the coax extends the full antenna length from a ground or reference plane. A further embodiment uses a filter designated at each of the various insertion points of the antenna to allow diplex functionality.

Figure 1:
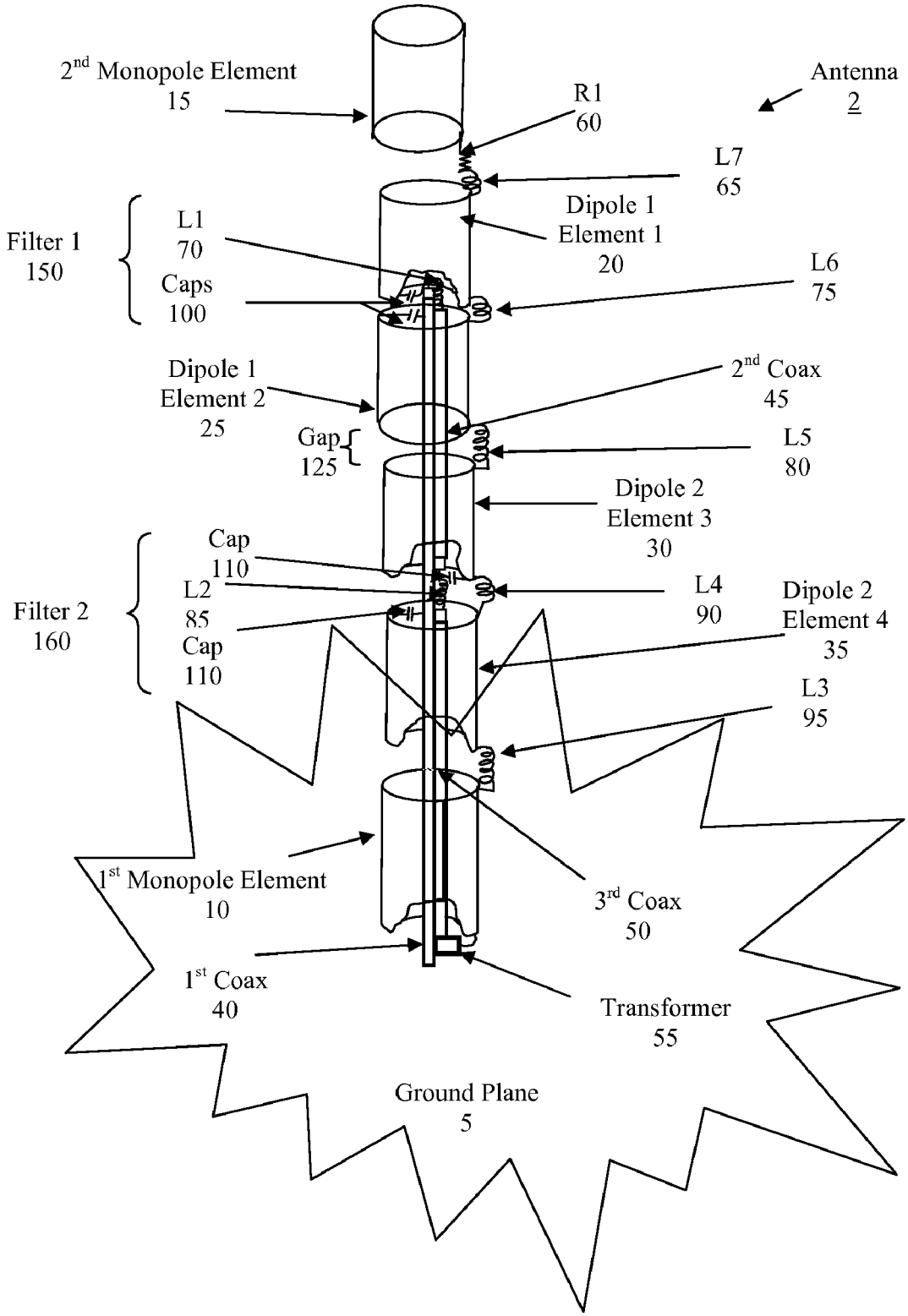
FIG. 1 is a block diagram perspective illustrating the broadband antenna configured in accordance with one embodiment of the present invention.

Referring to FIG. 1, a ground plane or reference plane 5 serves as the reference point for a plurality of antenna elements. In the depicted embodiment, at the ends of the ultra wideband linear antenna 2 there is a pair of monopole antenna elements 10, 15 disposed on opposing ends with a plurality of dipole antenna elements 20, 25, 30, 35 coupled therebetween. As used herein, the term ground plane does not necessarily have to be an infinite ground plane, but rather refers to a reference plane for the system operations. The ground plane 5 can be, for example, the roof of a vehicle.

A central feed coax 40 is coupled to the ground plane 5 and in this embodiment provides an electrical coupling for the signals among the various antenna elements. The central coaxial feed 40 can be disposed within the various hollow monopole and dipole elements according to one embodiment.

For illustrative purposes of one embodiment, the antenna elements are hollow tubular metallic sections having a diameter of about six inches. In other embodiments the tubular conducting elements include shapes such as square, oval, polygonic (e.g.: pentagon, hexagon, octagon), and even triangular in cross section. Thus, the term tubular is not to be considered limiting to a circular section but rather to include any hollow shaped sections. The antenna elements at either end are the monopole elements and are generally smaller in length than the dipole sections. The antenna elements can all be the same length or vary in length and shape depending upon the design criteria.

One simplistic antenna element construction is for the conducting elements to be metal foil on the outside of a fiberglass tube with all of the coax and other circuit elements inside of the tube. The outside metal sleeves that are attached to the inside circuit elements can use connecting components such as screws. For protection and uniform appearance, shrink tubing or appropriate coating could be placed over the complete outside structure.

Referring again to FIG. 1, the first dipole consists of the first dipole first element 20 and the first dipole second element 25 which are coupled to each other by a four terminal diplexing filter 150. The diplexing filter 150 in this embodiment comprises an inductor 70 and capacitors 100. The reference to capacitors as used herein includes physical capacitive components as well as features such as stubs that provide capacitance.

The second dipole is comprised not only of the second dipole antenna elements 30, 35, but also the first monopole 10 and the second element 25 of the first dipole. In more particular detail of this embodiment, the second dipole comprises the first monopole section 10 which is serially coupled to the second dipole fourth element 35 by inductor L3 95. The second dipole fourth element 35 and third element 30 are operatively coupled by the second diplexing filter 160. The third dipole element 30 is coupled to the second dipole element 25 of the first dipole by inductor L5 80. As shown, the individual dipole antenna sections 20, 25, 30, 35 of the first and second dipole antennas are shown as circular sections about the central coax 40 and separated by gaps 125 between successive sections. The size, shape and number of dipole antenna elements vary depending upon the design criteria.

On the opposing end from the ground plane, the second monopole element 15 is serially coupled to the upper end of the first dipole element 20 by and a resistor R1 60 and an inductor L7 65, wherein R1 and L7 form the monopole termination. The resistive element 60 located about $\lambda/4$ from the far end of the antenna improves isolation of the extremities and tends to improve the VSWR and performance over a portion of the frequency range.

The four terminal diplexing filters 150, 160 are described in further detail herein and allow diplex functionality. At one extremity of the coaxial cable 40, the highest frequency first dipole element 20 is fed with the first filter 150. The diplexing filter 150 couples the first dipole antenna with elements 20 and 25 to the coax 40 via capacitors 100. Besides diplexing filters 150, 160, there are other techniques to couple the first dipole antenna elements 20, 25 to the coax 40, such as a series resonant network. As further described herein, the filter trap and series resonant network allow for diplex functionality and shall generally both be termed filter.

The first dipole antenna having a first dipole element 20 and a second dipole element 25 are fed by a pair of capacitors 100 coupled to the first or central coaxial cable 10 via the first filter 150. The pair of capacitors 100 typically has a low reactance at the frequency range of the first dipole antenna formed from the first and second dipole elements 20, 25. As the frequency is lowered, less energy flows through the capacitors 100 because of the high reactance and more energy flows through the inductor L1 70 into the second coaxial cable 45. At the far end of the second coaxial cable 45, the second dipole third element 30 and second dipole fourth element 35 are fed from the pair of capacitors 110 from the second filter unit 160. As described herein, as the frequency is lowered below the frequency range of the third and fourth elements 30, 35, of the second dipole, the reactance of the filter capacitors 110 gets large and the reactance of L2 85 becomes small, thus causing more energy to flow into the third coaxial cable 50.

The center conductor of the first coaxial cable 40 contains the lower extremity of the frequency band under consideration. The center conductor of the third coaxial cable 50 feeds the base of the first monopole 10 and the shield can be coupled to the reference plane 5. At the connection point of the third coaxial cable 50 and the first monopole element 10, the impedance is in the order of about 200 ohms and a transformer 55 is an optional feature that can be used to provide an improved impedance match.

For example, if the first dipole operated at about 0.3 wavelengths to about 1 wavelength. The inductively loaded dipole would operate a little lower than 0.3 wavelengths, for example about 0.2 wavelengths.

Figure 2:
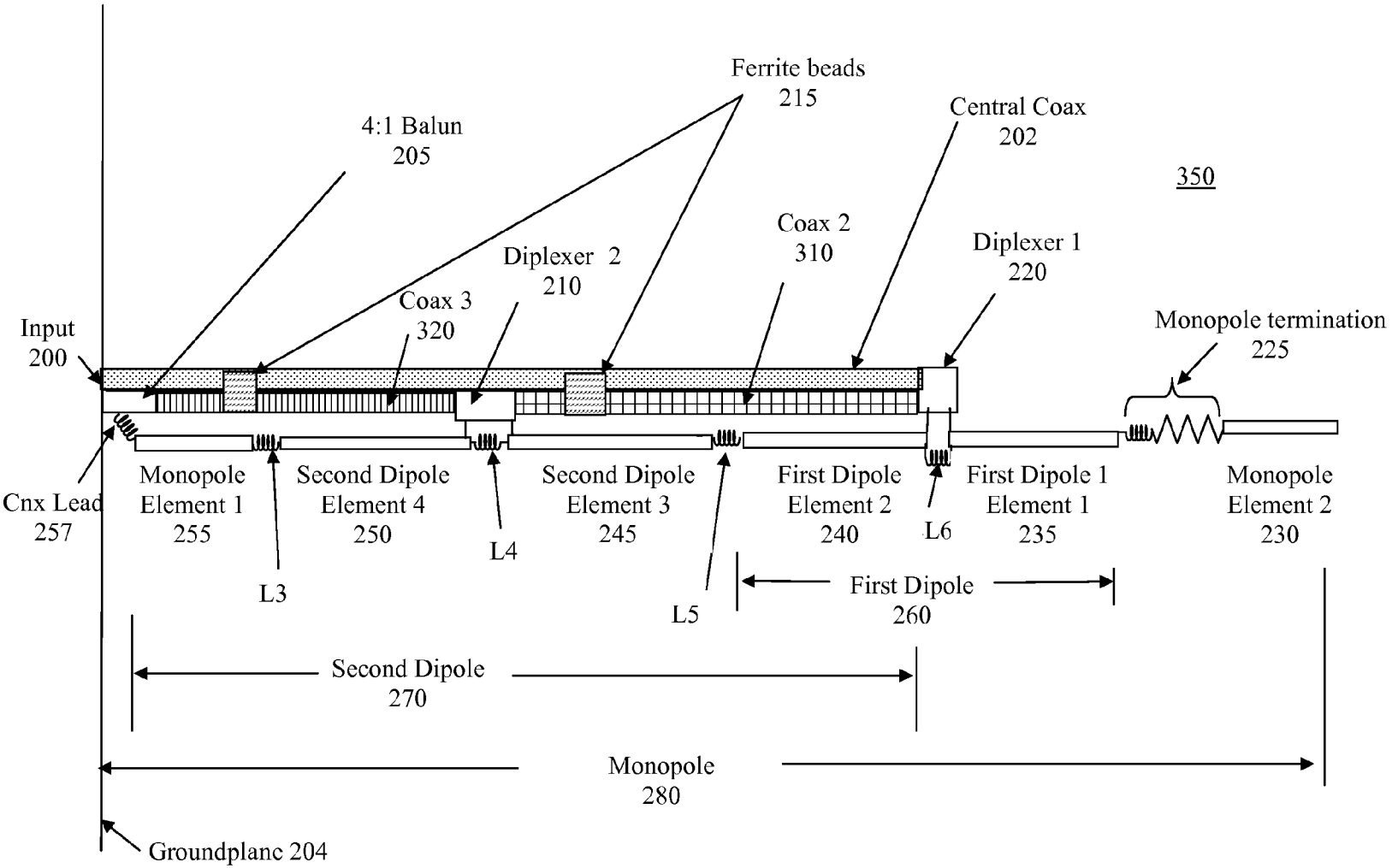
FIG. 2 is a schematic perspective illustrating the broadband antenna configured in accordance with one embodiment of the present invention.
Figure 3A:
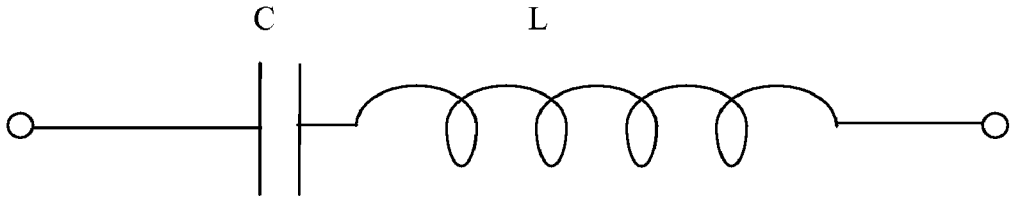
Figure 3a (Prior Art)
FIG. 3*a* is a simplified schematic perspective of a two terminal filter with a series coupled capacitor and inductor.
Figure 3B:
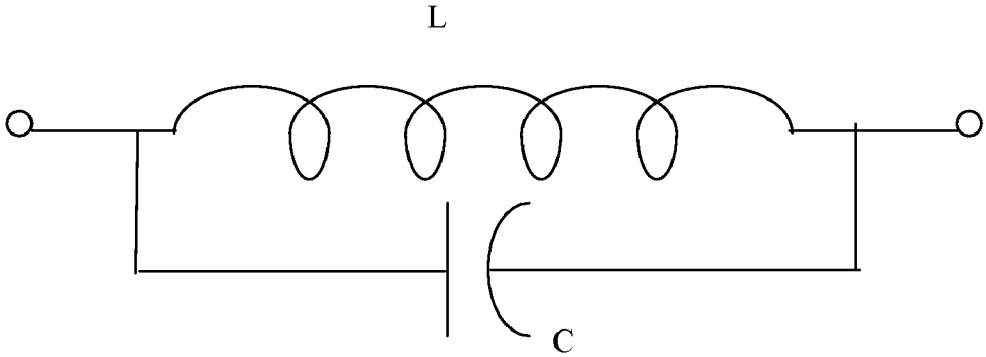
Figure 3b (Prior Art)
FIG. 3*b* is a simplified schematic perspective of a two terminal filter with a parallel coupled capacitor and inductor.

Referring to FIG. 2 a schematic perspective is illustrated for an embodiment of the broadband antenna of the present invention wherein a plurality of varying length monopole/dipole elements 230, 235, 240, 245, 250, 255 are isolated and/or combined as required in order to accommodate the self adjusting electrical length of two or more dipole antennas 260, 270 and a monopole antenna 280 over the desired frequency range. As known in the art, a dipole consists of two sections or arms that make up the dipole antenna. Therefore as illustrated, a first dipole 260 consists of element 235 and element 240. The second dipole 270 comprises elements 245 and 250 as well as the extremities of monopole element 255 and the first dipole second element 240. The monopole element 255 is coupled to dipole element 250 by inductor L3 whereas the dipole element 240 is coupled to element 245 by inductor L5.

In one embodiment, an input signal 200 is coupled on a first end of a central coaxial cable 202 about a ground or reference plane 204. The central coaxial cable 202 extends from the reference plane 204 to the first diplex 220 on a second or opposing end. Along the central coaxial cable 202 can be one or more ferrite beads 215 to prevent the jacket of the coaxial cable 202 from shunting the various dipoles 260, 270 to ground 204. A second coax section 310 is approximately parallel to the central cable 202 and extends from the first diplex 220 to a second diplex 210. A third coax section 320 is also approximately parallel to the central coax 202 and extends from the second diplex 210 back to the reference plane 204 via a balun 205 via a connecting lead 257 such as an inductor that couples the monopole element 1 255 to the balun 205.

A number of the dipole/monopole elements 230, 235, 240, 245, 250, 255 surround the central feed coax 202 and extend the full length of the antenna 350. At the opposing end of the central coax 202 at the first diplex is a first dipole antenna 260 having a first dipole first element 235 and a first dipole second element 240 which are fed via the first diplex 220. The two elements 235, 240 operate as a unit to form the first dipole antenna 260. As should be readily understood, a diplex circuit, or more simply a "diplexer," is a device which separates or combines RF signals thereby allowing the total length of the antenna to be 'adjusted' and affecting the reception characteristics. With respect to the self adjusting aspects for the first dipole antenna 260, at higher frequencies, more energy is directed to the highest frequency first dipole first element 235 of the first dipole 260. As the frequency is lowered, more energy is directed to the lower frequency first dipole second element 240 of the first dipole 260. At even lower frequencies, energy flows through the second coaxial cable 310. Thus, because of the diplexer action, the feed point moves as a function of frequency thus selecting the first dipole 260 in one frequency range, the second dipole 240 for another frequency range, and so on.

The second coaxial cable 310 is coupled between the first diplexer 220 and the second diplexer 210. It is coupled to the central coax 300 via the first diplex circuit 220. At certain frequencies lower than those handled by the first dipole 260, signal energy flows through the first diplex 220 and through the second coaxial cable 310 to the second diplex 210. Signal energy is then directed to the second dipole third element 245 while at still lower frequencies, more energy is diverted to the second dipole fourth element 250.

And at even further lower frequencies, the energy flows through the second diplex 210 into the third coaxial cable 320. The third coaxial cable 320 is coupled between the second diplex unit 210 and the transformer 205, which is a 4:1 balun in this embodiment.

There are two dipole antennas 260, 270. The first dipole antenna 260 is established by the first dipole first element 235 and the second dipole second element 240 and coupled by the four terminal first diplex circuit 220. The second dipole antenna 270 comprises the third and fourth dipole elements 245, 250 operatively coupled by the second diplex 210. The second dipole 270 also comprises the first monopole element 255 and second dipole element 240 of the first dipole 260. In this embodiment, the length of the monopole antenna 280 extends the full length of all the antenna elements from the reference plane 202 to the end of the opposing monopole element 230.

One embodiment of the present invention uses ferrite rings 215 placed at various points along the central coaxial cable 300, second coaxial cable 310, and third coaxial cable 320 to prevent the coaxial jackets from shunting the various dipole sleeves to ground 202.

An example of the frequency range of the illustration would be first monopole and second monopole operating at about 20 to 150 MHz; the first (highest frequency) dipole elements operating at about 450 to 1500 MHz and a second dipole elements operating at about 150 to 450 MHz. This would have a height of about 90 inches above the ground plane. Such a system provides a counter poise for the monopole and would have insignificant tilting effects on the dipoles. It should be readily understood that the present invention is not limited to this bandwidth example. The bandwidth can be extended by coupling more dipoles and associated filter elements. Also the input cables can be separated if so desired depending upon system requirements.

According to one embodiment, multiple elements are isolated and/or combined to provide self adjusting electrical lengths over a large frequency extent. The self adjusting aspects are related to the diplexer action wherein the feed point moves as a function of frequency. Therefore, this allows the system to automatically 'select' dipole 1 in one frequency range, dipole 2 in another frequency range and so forth.

In operation according to one embodiment, assume that transmit energy is flowing into the input port 200. This energy will flow up the central coax 202 until it reaches diplexer 1 220. The energy of the highest frequency band will flow through the capacitors of diplexer 1 220 into the dipole elements 235 and 240 representing dipole antenna 1 260. This occurs because the reactance of the capacitors in this band is relatively low. As the frequency is lowered to the next band of interest, the capacitor(s) of diplexer 1 220 have a higher reactance and thus pass much less energy at this lower band into dipole 1 235. Also the inductance of diplexer 1 220 has a high reactance in the highest band restricting the highest band from propagating on to coax 2 310.

At the next lower band the inductive reactance of diplexer 1 220 is much lower and the energy passes through to coax 2 310. The capacitors of Diplexer 2 210 have a low reactance in this lowered band and the energy propagates through them into the second dipole 250 and 245. Now at the lowest band the capacitors of diplexer 2 220 have a high reactance thus preventing propagation into the second dipole. Also the inductance of diplexer in the lowest band is low thus permitting energy to flow into coax 3 320. This low band energy now flows in the 4:1 transformer 205 to feed the monopole 280 against the ground plane 202. At various points along the structure, inductors are placed across the dipole feed terminals and in series with the monopole element 280. These inductors lower the natural low frequency of the monopole some what and provide isolation between the dipole elements and the monopole.

As described herein, at various points along the central coax 300, coax 2 310 and coax 3 320, ferrite beads 215 can be placed to minimize the shunting effect of the coax cable.

The values for the various components such as the resistors, capacitors and inductors are typically derived from computer modeling and circuit theory, although they can be also be empirically derived via experimentation.

Figure 4A:
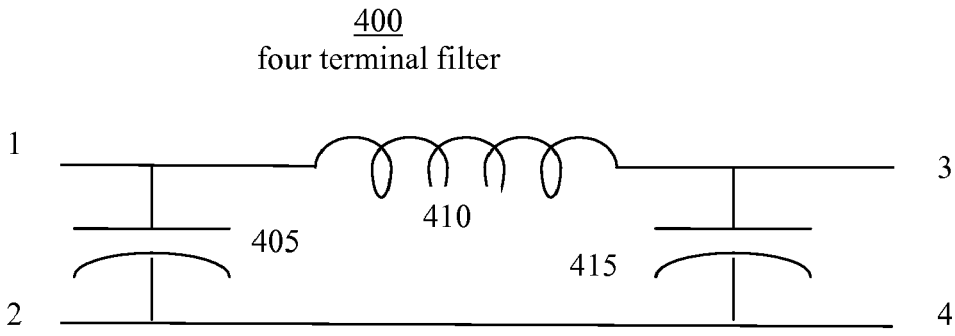
FIG. 4*a* is a simplified schematic perspective of a four terminal filter.
Figure 4B:
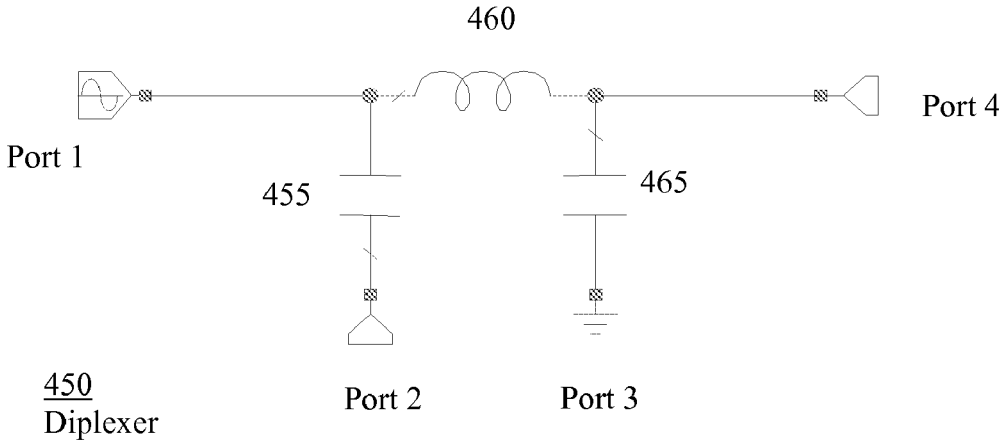
FIG. 4*b* is a simplified schematic perspective of a four terminal diplex circuit configured in accordance with an embodiment of the present invention.

Referring to FIG. 4*a* and FIG. 4*b*, a four terminal filter and a four terminal diplexer are illustrated. In FIG. 4*a*, the four terminal filter in this embodiment is an L/C filter 400 having a first capacitor 405 coupled between port 1 and port 2. An inductor 410 is coupled in series between port 1 and port 3. There is a second capacitor 415 coupled between port 3 and port 4. In distinction to the two terminal filters, the four terminal filter allows greater flexibility and improved filtering characteristics.

A four terminal simple diplexer 450 is shown in FIG. 4*b*. For illustrative purposes, the structure is described herein with values and signal levels, however such values and designations are not to be deemed as limitations. An incoming signal having a power level of 56 dBm and a 50 ohm impedance is introduced at port 1. The higher frequency signals are output at port 3 through the capacitor 455, such as a 27 pF capacitor, wherein port 3 might be the first dipole first antenna element. The lower frequency signal goes through the inductor 460, such as a 96nH inductor, and is output at port 4. While port 3 is grounded via capacitor 465, such as 56 pF capacitor, in this filter option, in another embodiment port 3 may couple to the first dipole second antenna element.

Figure 5:
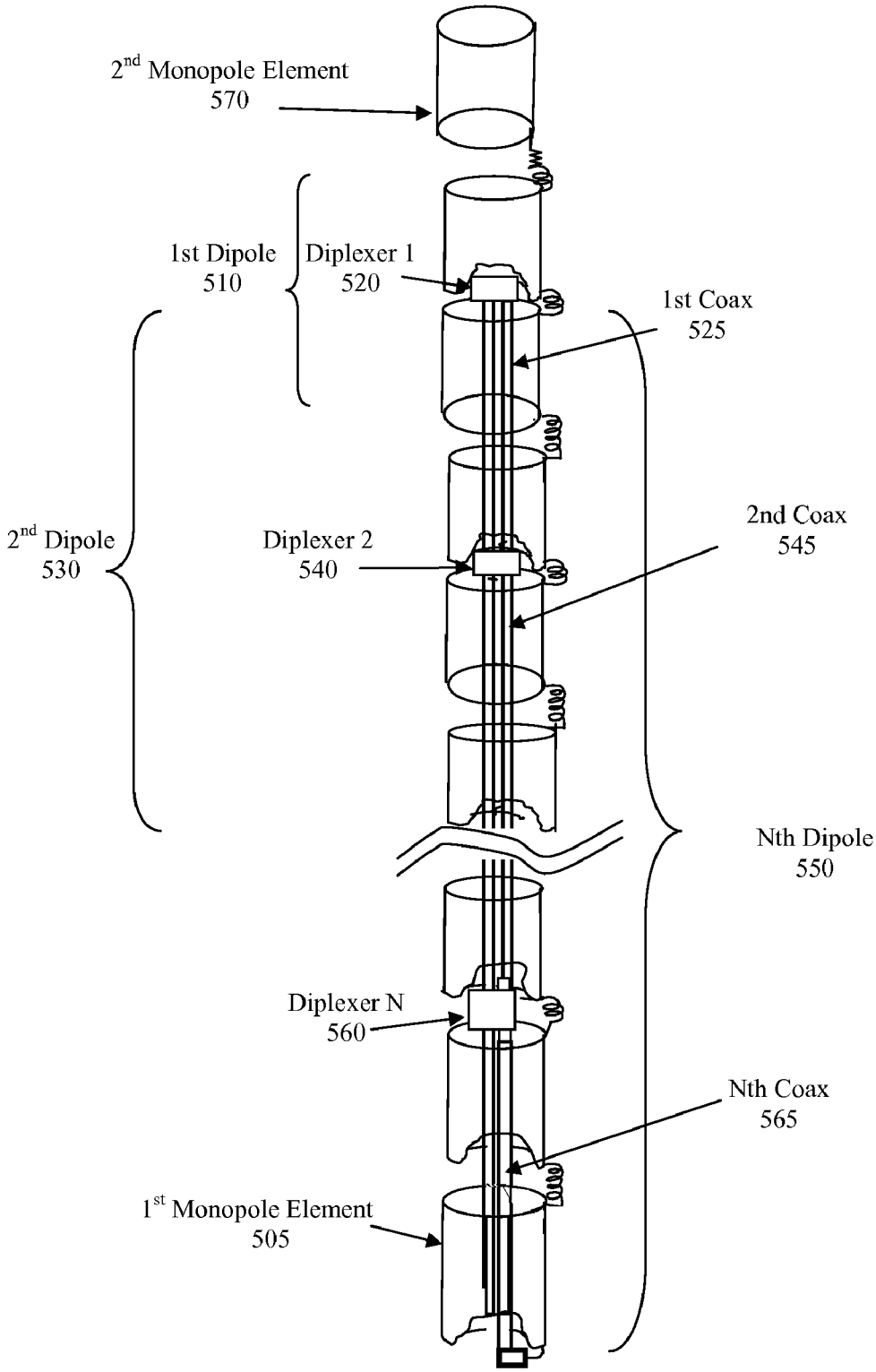
FIG. 5 is a block diagram perspective of wideband antenna with multiple dipole antennas configured in accordance with an embodiment of the present invention.

FIG. 5 illustrates one embodiment incorporating at least one additional dipole antenna, at least one additional diplexing filter, and at least one additional coaxial section, as further detailed herein. In this embodiment there are multiple dipole antennas 510, 530, 550 and diplexers 520, 540, 560 with corresponding coaxial sections 525, 545, 565. The first dipole antenna 510 is established by the first dipole elements coupled by the first diplex circuit 520. The second dipole antenna 530 comprises dipole elements and additional elements as described herein, operatively coupled by the second diplexer 540. Additional elements are isolated and/or combined to provide self adjusting electrical lengths over a large frequency extent for additional dipole antennae. The self adjusting aspects are related to the diplexer action wherein the feed point moves as a function of frequency. Thus, because of the diplexer action, the feed point moves as a function of frequency thus selecting the first dipole in one frequency range, the second dipole for another frequency range, and so on. In this embodiment, the length of the monopole antenna extends the full length of all the antenna elements from the reference plane (not shown) and the first monopole element 505 to the end of the opposing second monopole element 570.

By way of further example, assuming that the traveling wave monopole was demonstrated to operate with about a 7:1 bandwidth and fat dipoles will perform about 2.5 to 3:1 bandwidth. Thus, 7×3×3=63:1 overall bandwidth. One of the valuable features of this invention is that radiation will primarily be single lobed and will be broadside to the axis of the antenna.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A wideband antenna, comprising:

a central coaxial feed having a first end coupled to a reference plane and a second end coupled to a first diplexing filter, a first coaxial section having a first end of said first coaxial section coupled to said first diplexing filter and an opposing end of said first coaxial section coupled to a second diplexer filter, wherein a first end of a second coaxial section is coupled to said second diplexer filter and an opposing end of said second coaxial section coupled to a transformer, and wherein said transformer is coupled to said reference plane;

a first dipole antenna coupled to said first diplexing filter;

a second dipole antenna coupled to said second diplexing filter; and a monopole antenna coupled to said transformer.

2. The antenna according to claim 1, wherein said wideband antenna has a self adjusting electrical length based on a frequency of said signal.

3. The antenna according to claim 2, wherein said self adjusting electrical length comprises said first diplexing filter providing a first frequency path to said first dipole antenna and a second frequency path to said first coaxial section, said first coaxial section coupling to said second diplexing filter and said second dipole antenna, and wherein said second filter provides a third frequency path to said second coaxial section which is terminated in said transformer and said monopole antenna.

4. The antenna according to claim 3, wherein said second frequency path is for a lower frequency than said first frequency path.

5. The antenna according to claim 1, wherein said first dipole antenna, said second dipole antenna and said monopole antenna are substantially disposed about said central coaxial feed, said first coaxial section and said second coaxial section.

6. The antenna according to claim 1, wherein said first dipole antenna comprises a pair of opposing dipole elements coupled to each other at said first diplexing filter, said second dipole antenna comprises a pair of opposing dipole elements coupled to each other at said second diplexing filter, and wherein said monopole antenna comprises a pair of monopole elements coupled at either end of said antenna.

7. The antenna according to claim 6, wherein said dipole elements and said monopole elements have a cross-section shape selected from at least one of the group consisting of: circular, square, polygonic, oval, and triangular.

8. The antenna according to claim 1, wherein said first and second diplexing filter is selected from the group consisting of: four terminal trap filter and series resonant circuit.

9. The antenna according to claim 1, wherein said antenna achieves bandwidths of at least about 50:1.

10. The antenna according to claim 1, further comprising at least one additional dipole antenna, at least one additional diplexing filter, and at least one additional coaxial section.

11. An antenna system for wideband operations having a monopole antenna and at least one self-adjusting dipole antenna, comprising:

a plurality of tubular sections forming said at least one dipole antenna, and said monopole antenna, said dipole antenna having dipole sections linearly disposed between a first monopole element and a second monopole element, wherein said dipole sections and said first and second monopole element are electrically coupled;

a central coaxial feed linearly disposed proximate said tubular sections and coupled on a first end to an input signal about a reference plane;

at least one coaxial section linearly disposed proximate said tubular sections and coupling between said reference plane and a second end of said central coaxial feed; and at least one four terminal diplex unit coupled between each said dipole antenna.

12. The system according to claim 11, further comprising at least one ferrite bead coupled about at least one of said central coaxial feed and said at least one coaxial section.

13. The system according to claim 11, wherein said diplex unit provides two frequency paths depending upon a frequency of said input signal.

14. The system according to claim 11, said at least one self-adjusting dipole antenna further comprising at least one additional dipole antenna, at least one additional diplex unit, and at least one additional coaxial section respectively coupled therewith.

15. The system according to claim 11, wherein said first monopole element is coupled to said reference plane and said second monopole element is coupled to said dipole antenna by a resistive element.

16. The system according to claim 11, further comprising a transformer coupling between said reference plane and said first monopole element.

17. The system according to claim 11, wherein said tubular sections are hollow fiberglass units with a metal coating.

18. A method for providing broadband coverage from a combination of at least two dipole antenna and a monopole antenna, comprising:

feeding an input signal to a first dipole antenna from a first coaxial cable via a diplexer for a first frequency range;

automatically switching from said first dipole antenna to a second coaxial cable for a second frequency range, wherein said second frequency range is lower than said first frequency range;

feeding a second dipole antenna coupled to said second coaxial cable with said second frequency range;

automatically switching from said second dipole antenna to a third coaxial cable for a third frequency range, wherein said third frequency range is lower than second frequency range; and feeding said monopole antenna with said third frequency range.

19. The method according to claim 18, further comprising feeding an additional dipole antenna coupled between said second dipole antenna and automatically switching from said second dipole antenna to an additional coaxial cable for an additional frequency range, wherein said additional frequency range is between said second frequency range and said third frequency range.

20. The method according to claim 18, wherein said automatically switching is from a four terminal diplexer.

* * * * *